United States Patent [19]

Vago

[11] Patent Number: 4,888,834

[45] Date of Patent: Dec. 26, 1989

[54] BATHING SYSTEM

[75] Inventor: Robert E. Vago, Northbrook, Ill.

[73] Assignee: Malmros Holding, Inc., Morton Grove, Ill.

[21] Appl. No.: 159,192

[22] Filed: Feb. 23, 1988

[51] Int. Cl.[4] ..... A47K 3/022

[52] U.S. Cl. ..... 4/540

[58] Field of Search ..... 4/538, 540, 542, 543, 4/544, 545

[56] References Cited

U.S. PATENT DOCUMENTS

| | | | |
|---|---|---|---|
| 4,280,234 | 7/1981 | Sax | 4/540 |
| 4,530,121 | 7/1985 | Penney | 4/540 |
| 4,592,099 | 6/1986 | Zellner | 4/540 |

FOREIGN PATENT DOCUMENTS

| | | | |
|---|---|---|---|
| 1482601 | 4/1967 | France | 4/540 |

*Primary Examiner*—Philip R. Coe

*Attorney, Agent, or Firm*—Vincent L. Carney

[57] ABSTRACT

To permit comfortable bathing by an ambulatory patient without the assistance of another person, a bathing system includes a movable portion and a stationary portion, with a movable portion including a tub that pivots between a bathing position and an entering-and-exiting position. The stationary portion includes a seat for the patient which remains stationary as the tub moves, a drive mechanism for the bath tub and a source of warm sparging air and warm circulating air. When the tub is in the entering-and-exiting position, the chair is positioned so the patient can enter it easily but recessed within the tub walls so that he is partly encompassed by the tub and the warm air is able to circulate around the patient. The pivot point and size of the tub permit the tub to fit within an alcove. Controls are mounted so that the patient may manipulate the tub from position to position and control the warm air and water.

20 Claims, 5 Drawing Sheets

BATHING SYSTEM

BACKGROUND OF THE INVENTION

This invention relates to bathing systems and more particularly to a bathing system which is easy to use by bathers who are sufficiently ambulatory to enter, bathe and exit without the assistance of another person but who may otherwise be ill or handicapped to the extent that a stationary bathtub is difficult or dangerous for them to use.

In one class of bathing system, the tub pivots to a position in which it is easier for a patient to enter than the normal bathing position of the tub. After the patient has entered the tub, the tub pivots to a bathing position where it can be filled with water for bathing After bathing, the tub is drained and pivoted to a position in which the patient more easily leaves the tub.

In one type of prior art bathing system of this class, the tub pivots about one end, which end has mounted near it the necessary plumbing for filling the tub with water. The seat is horizontal when the tub is pivoted for entering but moves to a vertical position so that the bather is supine during bathing. The controls and faucets are not within easy reach of the bather and must be operated by another person.

This prior art type of bathing system has several disadvantages, such as: (1) it requires bathing in the supine position but most bathers prefer to be in a sitting position during bathing rather than in a supine position; (2) it requires two people since the bather cannot operate the controls; and (3) it is not convenient for a bather that is partly ambulatory to move unassisted from a wheelchair or the like into the seat of a bathing system.

In another type of prior art bathing system of this class, a chair is mounted to a stationary support and remains stationary as the tub is pivoted about an axis. The axis in a first embodiment is in front of the chair, and in a second embodiment, is located closely adjacent to the back rest of the chair. In the first of these embodiments, the tub pivots upwardly to permit the patient to enter from the sides and in the second embodiment, the tub is pivoted backwardly so that a patient can enter from the sides or from the front A bathing system of this type is described specifically in U.S. Pat. No. 3,641,596.

This type of bathing system has several disadvantages such as: (1) it requires substantial space particularly in elevation to permit the pivoting of the tub about a relatively high axis; (2) the tub must generally be formed in an irregular fashion to conserve space; and (3) the patient is exposed to air which may chill the patient. There are two time periods during which the patient is exposed to chilling air in this prior art type of bathing system, which are: (1) from the time the patient enters the chair of the bathing system until the tub has been rotated into bathing position and filled with water; and (2) even more harmfully, during the time period occurring after the patient has been bathed but while the tub is being drained and pivoted into the entering-and-exiting position until the time the patient has left the bathing system.

In still another prior art type of bathing system, a seat and a tub are movable with respect to each other to permit easy entrance of the patient. The seat may be kept warm when the tub is not filled by a warm fluid which fills a chamber formed by tub portions and the back of the seat.

This type of prior art bathing system does not disclose a solution to the problem of mounting a bathing system within a closed space nor of providing warmth fully to the upper portion of the patient since it only provides for warming the seat itself. Thus, the patient is exposed to cold air and may be chilled thereby.

SUMMARY OF THE INVENTION

Accordingly, it is an object of this invention to provide a novel bathing system.

It is a still further object of the invention to provide a bathing system especially designed to be easy to enter by a patient and yet to fit in a confined space.

It is a still further object of the invention to provide a bathing system in which the top pivots to permit easy entry by a patient but may be used by the patient without the aid of another person.

It is a still further object of the invention to provide a bathing system in which the bather remains stationary while the tube pivots between a bathing position and an entering-and-exiting position and which provides warmth to the bather while the tub is in the entering-and-exiting position.

In accordance with the above and further objects of the invention, a bathing system includes a tub adapted to hold water and a seat adapted to support a person in sitting position. The tub is movable from an entering position to a bathing position and then to an exiting position. In the bathing position, the tub holds water and the seat is located to permit the bather to be immersed in water within the tub. In the entering position, the tub is vertical to permit easy access to the seat by the bather, with the seat being positioned so that the patient is within the tub and sitting.

To provide the necessary warmth while the patient is seated but before the tub is filled with warm water or after the tub has been emptied, the tub in its entering-and-exiting position, fits around the patient so that its edge is substantially in front of the patient, with the patient fitting within the concave portion of the tub. Warm air is circulated around the patient within this partial enclosure to keep the patient warm. While the tub is being emptied and during the time a patient is taking a shower, warm air moves upwardly from a location below the seat to warm the patient.

In some embodiments, the tub is automatically driven from position to position and the application of water and air are automatically controlled using a simple control panel. In both the bathing and entering-and-exiting positions of such embodiments, the controls for moving the tub are positioned such that the patient may reach them while remaining seated and thus operate the controls to pivot the tub from an entering position to a bathing position and from a bathing position to an exiting position.

To permit use of the tub within a relatively confined space, the pivot axis for the tub is at an elevation from the floor or other support upon which it is mounted within the range of 15 inches to 40 inches and is mounted at a location within one foot of the center of the longitudinal axis of the tub. It crosses the longitudinal axis of the tub orthogonally at a location sufficiently far from any part of the tub to permit the tub to move between a vertical position and a horizontal position about the seat without contacting the seat and to have the seat within its concave portion both in the bathing position and the entering-and-exiting position of the tub. In the preferred embodiment, it crosses orthogonally the center of the longitudinal axis six inches from the edges of the open end of the tub.

To permit control of the bathing system by the bather, a control panel is mounted within reach of the operator. To this end, the control panel is located at an elevation above the water line when the tub is in a bathing position and less than 3 feet from one of the rear corners of the seat in both the entering-and-exiting position and in the bathing position of the tub. In the preferred embodiment, the center of the control panels are substantially 17 inches from a rear corner of the seat in the entering-and-exiting position and 28 inches in the bathing position so that in both positions the control panel is within reach of the patient.

The tub has a drain opening n the bottom which can be sealed or opened by the patient to permit draining of liquid from the tub. Faucets extend from a location clearing the edge of the tub when it moves between its entering-and-exiting position and its bathing position, overlying the tub to permit the flow of water into it when it is in the bathing position and at a location spaced a sufficient distance from said seat to not interfere with the patient entering the tub when it is in its bathing position.

The tub has: (1) an inner depth of between 20 inches and 35 inches and is substantially 28 inches in the preferred embodiment; (2) a length along its longitudinal axis in the inside of the tub of between 40 inches and 60 inches and in the preferred embodiment substantially 52 inches; (3) an inner width of between 20 and 35 inches and in the preferred embodiment substantially 28 inches; and (4) a radius of curvature as it pivots through 90 degrees between its entering-and-exiting position and its bathing position of between 25 and 40 inches and in the preferred embodiment substantially 32 inches for its outside surface and 26 inches for its inside surface.

The seat is mounted at a level: (1) from the top edge of the tub in the bathing position of between 25 and 40 inches to permit the water line to be high enough on the patient for bathing; and (2) from the top of the tub in the entering-and-exiting position of 32 to 45 inches. In the preferred embodiment, it is at a level that provides 32 inches in a straight line along the backrest to the inner wall of the tub and at least six inches above the bottom of the tub when the tub is in its bathing position.

From the above description, it can be understood that the bathing system of this invention has several advantages such as: (1) it can be easily entered by a partly ambulatory patient and operated by the patient without the aid of another person; and (2) the patient remains in a seated position without moving while the tube is moved from an entering position to a bathing position and back to an exiting position.

DESCRIPTION OF THE DRAWINGS

The above noted and other features of the invention will be better understood from the following detailed description when considered with reference to the accompanying drawings in which.

DETAILED DESCRIPTION

Figure 1:
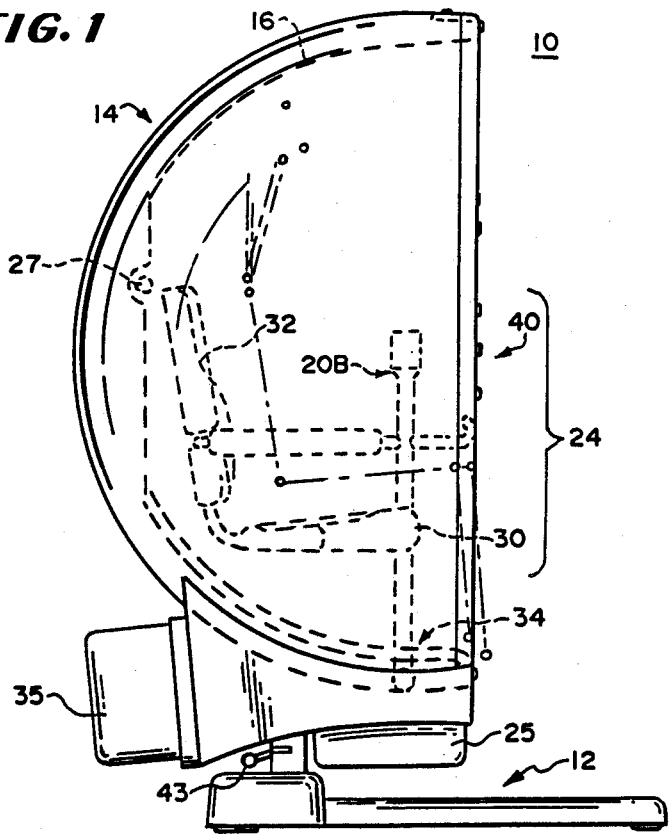
FIG. 1 is a side elevational view of one embodiment of a bathing system illustrating the position of the tub and seat when the tub is in a position to be entered by the bather.

In FIG. 1, there is shown a bathing system 10 having a stationary structure 12 and a moving structure 14. The moving structure 14 includes a bathtub having a tub wall 16 of sufficient size to permit bathing of a person and sufficient strength to permit filling with water. The stationary structure 12 includes a seat means 24, a tub positioning means 25 and a warm air circulating means 27.

The moving structure 14 of the bathing system 10 is shown in FIG. 1 in a position which permits the bather to enter it, generally under the bather's own power, and then to pivot the moving structure 14 into a bathing position (FIG. 3) without changing the position of the patient seated in the bathing system 10. The operator may then fill the tub with water, bathe, empty the tub, move the tub back to the entering-and-exiting position and leave the tub.

To accommodate ambulatory patients comfortably in the entering-and-exiting positions, the tub wall 16 forms a bathing compartment that: (1) has an inner length along its longitudinal axis sufficient to not interfere with the bathers head or legs when the bather is sitting in the chair as the tub is moved to and from the bathing position; (2) is supportable at a central pivot axis located to provide clearance to the chair and patient as the tub moves; and (3) has a depth sufficient to extend around the patient's sides so as to keep the patient warm with circulating warm air.

In the preferred embodiment, the tub wall is shaped as one half of an ellipsoid, cut along its major axis to form an ellipse in the cutting plane including the edge of the walls forming the open end of the half-ellipsoid-shaped tub. The pivot axis of the tub is parallel to the plane about the open end and orthogonal to a plane passing through the major axis of the ellipsoid and the center of the tub. The pivot axis is generally centered to permit the tub wall 16 to be adjacent to the ground as it moves from position to position about a pivot axis. In this tub, the major axis is also the longitudinal axis. In this description, the width of the tub may from time to time be referred to as the minor axis and the depth as the semimean axis.

The seat means 24 includes first and second pivot means, one of which is shown at 20B, a seat portion 30, a backrest portion 32, and a foot rest portion 34. The seat portion 30, backrest portion 32 and foot rest portion 34 are supported about the pivot means 20 to remain stationary as the tub wall 16 is moved from position to position. The pivot axis is within a range of 25 inches to 40 inches in elevation from the floor and is mounted at a location within one foot of the center line of the longitudinal axis of the tub at a distance from the bottom of the tub of between 15 inches to 30 inches.

To permit adequate room for the leg and the foot, the opposite end of the seat means 24 is at a distance from its uppermost portion of between 10 inches and 16 inches. The foot rest portion 34 is generally located within a distance of 1 foot to 2 feet of the top edge of the seat portion 30 but at a distance sufficiently long to clear the tub wall 16 during movement. To provide adequate clearance for the head as the tub moves, the junction between the seat portion 30 and the backrest portion 32 is between 32 inches and 45 inches along a line following the angle of the backrest portion 32 although it is closer to the wall at its closest portion behind the seat portion 30.

To permit easy control of the warm air and the positioning of the tub, one or more control sections, such as for example the control section 40, may be positioned within reach of a person seated in the seat portion 30. In the preferred embodiment, when the tub is in its entering-and-exiting position, the center of the control section or sections is approximately 17 inches from the closest corner of the junction between the seat portion 30 and the backrest portion 32. Generally, the control section 40 should be located at an elevation above the water line when the tub is in a bathing position and less than 3 feet from one of the rear corners of the seat portion 30 in both the entering-and-exiting and the bathing positions of the tub. Such control sections may be separately mounted control knobs or switches or panels and may include indicators. They may control any function such as draining and filling the tub but in the preferred embodiment, these are done manually. For example, to drain the tub, a plug is attached to a string to be manually placed for blocking draining and pulled to drain. Moreover, the controls may be located in any convenient location.

To warm the patient in the entering-and-exiting position, the junction between the seat portion 30 and the backrest portion 32 is sufficiently far back from the edge to permit a partial enclosure around which the warm air may flow to warm the patient sitting in the chair such as between 10 inches and 30 inches. The warm air circulating means 27 includes an opening which enters through the inner partition of the tub wall 16 from a passageway between the inner and outer panels thereof connected to a blower 35 to supply warm air therethrough for blowing into the tub where it surrounds the bather sitting on the seat portion 30.

A self-heating blower is positioned in the enclosure 35 beneath the tub in the preferred embodiment to blow warm air through conduits into the tub in sufficient quantities to maintain the patient sitting in the chair warm in the upright position and to provide a drying action after the water has been drained from the tub and the patient is waiting to exit the tub. The blower is adjustable in flow rate under the control of a control knob located in a control section so that it may be operated by the patient from the seat portion 30. Instead of a self-heating blower, a separate blower and heater may be used.

To move the tub and provide heated air, the stationary structure 12 of the bathing system 10 includes first and second motors, a ninety-degree horizontal-plane indexing mechanism, a tub stop, and a vertical-plane motion transmission system (none of which are shown in detail in FIG. 1.). The first motor and a non-reversing gear drive pivots the tub wall 16 between the entering-and-exiting position and the bathing position, and the second motor drives a blower to provide warm air around the patient when the bathing system 10 is in the entering-and-exiting position and sparging air when it is in the bathing position. The indexing mechanisms, transmission, and tube stop aid in controlling the tub in a manner to be described hereinafter. In one embodiment, the first and second motors are controlled from the control section 40 and the horizontal locking and indexing mechanism is controlled by a lever 43. The self-heating blower is of the type used in whirlpool baths to provide sparging but are adapted to also provide warming air to the patient when the bathing system is in the entering-and-exiting position.

Figure 2:
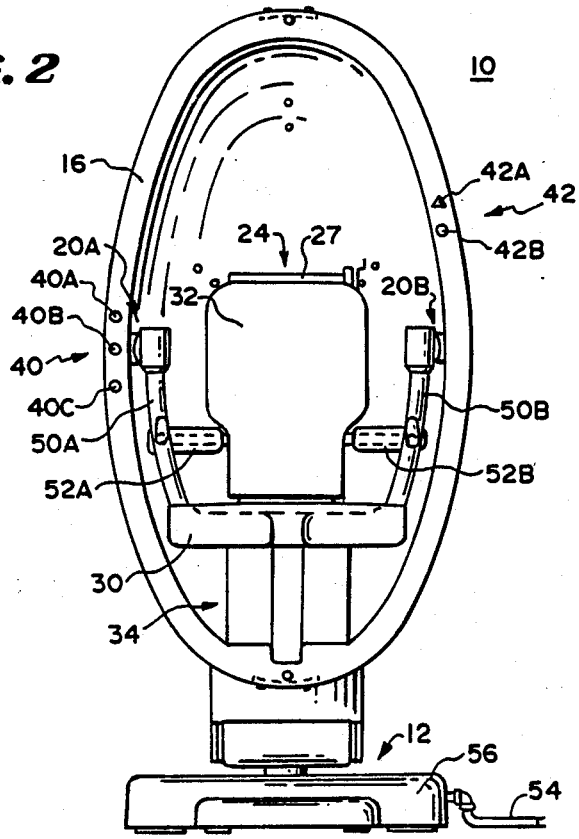
FIG. 2 is a front elevational view of the bathing system of FIG. 1 when the tub is in a position to be entered by the bather.

In FIG. 2, there is shown a front elevational view of the bathing system 10 showing the seat means 24, the tub wall 16, the stationary base 12, the warm air circulating means 27 and the pivot means 20A and 20B. As best shown in this view, the seat portion 30, backrest portion 32 and foot rest portion 34 are supported about the pivot means 20A and 20B by right and left support struts 50A and 50B, respectively to permit the seat portion 30 to remain stationary as the tub wall 16 pivots about the pivot means 20A and 20B. The right support struts 50A is connected to the right arm 52A of the seat portion 30 and the left support strut 50B is connected to the left arm 52B of the seat portion 30, with the right and left arms 52A and 52B being connected to the backrest portion 32 to support the arms of the patient and at the same time provide support from the right and left support struts 50A and 50B for the seat portion 30. The right and left support struts 50A and 50B extend beyond the right and left arms 52A and 52B of the seat portion 30 and are also connected to the backrest portion 32 for further support.

To provide warm air, the warm air circulating means 27 includes a hole pattern that extends across the tub wall 16 at a location slightly above the backrest 32 when the tub wall 16 is in its entering-and-exiting position but is positioned below the seat portion 30 of the seat means 24 when the bathing system is in its bathing position to provide a sparging liquid to the tub when full of water for therapeutic and cleansing action. Moreover, the seat portion 30 is cut away to provide access to the perineum for cleaning.

On the left-hand side of the tub wall 16 above the double wall and approximately opposite from the control section 40 so as to be on the left-hand side of the patient with the control section 40 being on the right-hand side of the patient, is another control section 42. The control section 40 includes: (1) a two position switch 40A to select motion to the entering-and-exiting positions from the bathing position or motion to the bathing position from the entering-and-exiting positions; (2) an electric power on-off switch 40B; and (3) a blower on-off switch 40C. The control section 42 includes a blower flow-rate control 42A and a plug-in port 42B for air operated accessories such as an hair-dryer or sparger disinfectant. To provide energy for the blower, heater and the motor for pivoting the tub wall 16, an electrical cable 54 is electrically connected through the base 56.

In the preferred embodiment, the tub is 28 inches across at its open end along the minor axis through the control section 40 orthogonal to the major axis with the seat means 24 being centered between the sides of the tub wall 16 but inset as described in connection with FIG. 1. The backrest portion 32 is approximately 14 inches across at a wider upper portion and 10 inches at a lower portion, extending upwardly approximately 19 inches to the warm air circulating means 27.

With this arrangement, the patient is conveniently seated within the center of the tub recessed inwardly, with warm air blowing toward the back of the seat portion 30 and circulating around him when the tub is in the entering or exiting position to provide warmth and drying action. Yet when the tub rotates to the bathing position, the warm air circulating means 27 is beneath the patient to provide sparging action during bathing and warm air during a shower or while draining the tub.

Figure 3:
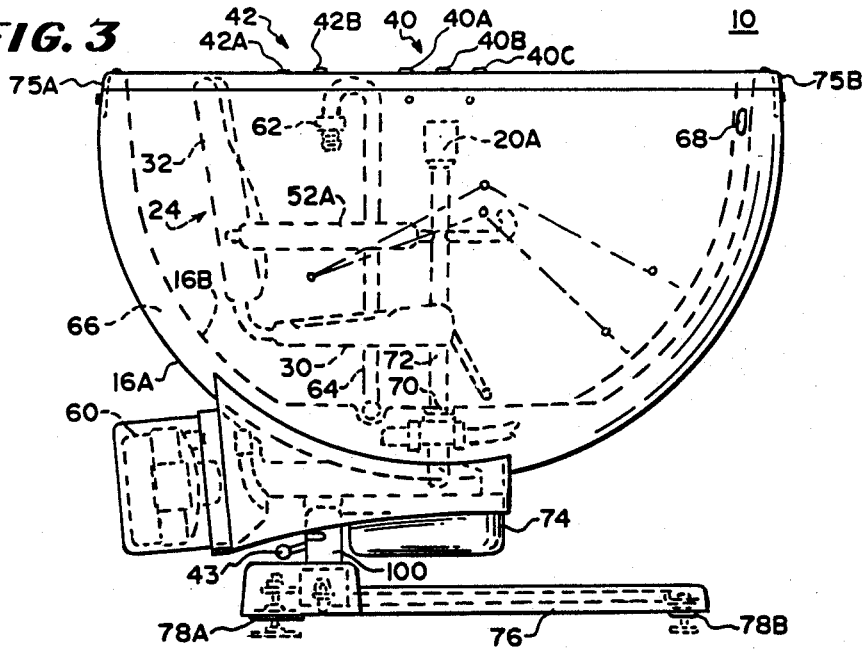
FIG. 3 is a side elevational view of the bathing system of FIG. 1 when positioned in its operative or bathing position.

In FIG. 3, there is shown a side elevational view of the bathing system 10 with the tub wall 16 in the bathing position so that the seat means 24 is positioned internally of the tub wall 16 to receive water and be immersed. The blower outlet is shown connected to a whirlpool blower housing 60 and from there through a hose connection 62 behind the tub for communication at 64 to the space 66 between the double tub walls 16A and 16B of the tub wall 16 to permit sparging air to be blown through the bath under the control of the patient in the manner of a whirlpool bath.

In this position as well as in the entering position of FIG. 1, the weight of the tub rests on a tubular cradle portion 72 and is welded at its base to the drive mechanism housing for moving the tub from position to position. This cradle portion is connected to an elevator housing 74 which in turn is mounted to a stand 76 containing conventional levelor screws, two of which are shown at 78A and 78B, for leveling the stand 76.

The drive mechanism includes a driven pinion (not shown in this FIG.) mounted to rotate within the housing 74 and a flexible curved rack (not shown in this FIG.) anchored at 75A and 75B and extending along 180 degrees of the tub wall 16 to be driven by the pinion 92 through at least 50 degrees and in the preferred embodiment through 90 degrees. The electric drive motor is mounted within the housing 74 and the flexible curved rack 90 is recessed in the double tub walls 16A and 16B of the tub wall 16. While fastened to extend over 90 degrees of tub wall, the rack 90, which is a toothed neoprene belt, need only extend through at least 50 degrees of wall for 50 degrees of pivoting and at least 90 degrees for 90 degrees of pivoting.

Figure 4:
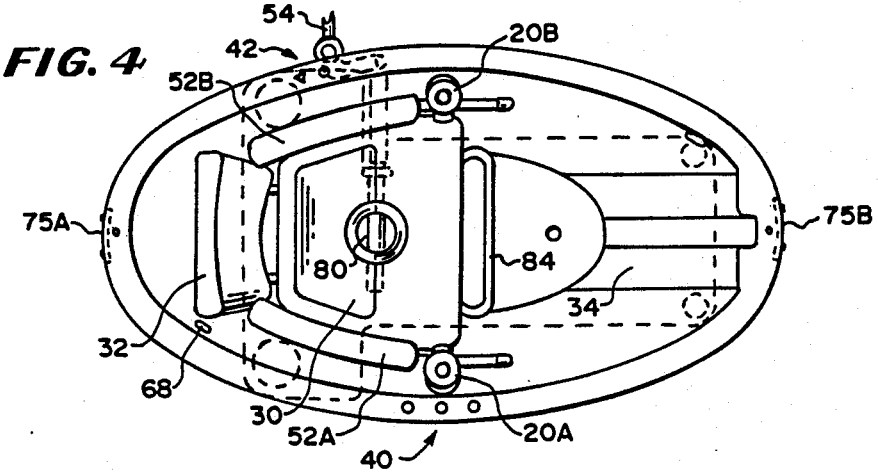
FIG. 4 is a top view of the bathing system of FIG. 3.

In FIG. 4, there is a top view of the bathing system 10 illustrating the manner in which the seat portion 30 is cut away such as at 80 above the sparger outlet. As shown in this view, the foot rest 34 depends downwardly from the edge of the seat portion 30 at 84 so that a patient sits comfortably in the seat portion 30 at a location within the tub where the the patient may have his torso covered with warm water and may receive a sparging gas through the water. The patient is also within reach of the control sections 40 and 42 (FIG. 2). The tub may be filled and when bathing is over, drained, so that the tub wall 16 may be moved to the exiting position shown in FIGS. 1 and 2.

As shown in FIG. 4, an overflow outlet 68 is mounted approximately 24 inches from the bottom of the tub and 4 inches from the top of the tub. A discharge outlet 70 for the release of water is positioned at the bottom of the tub where it may be controlled from the control section 40 by an operator to drain the tub prior to moving it back to the entering-and-exiting position.

Figure 5:
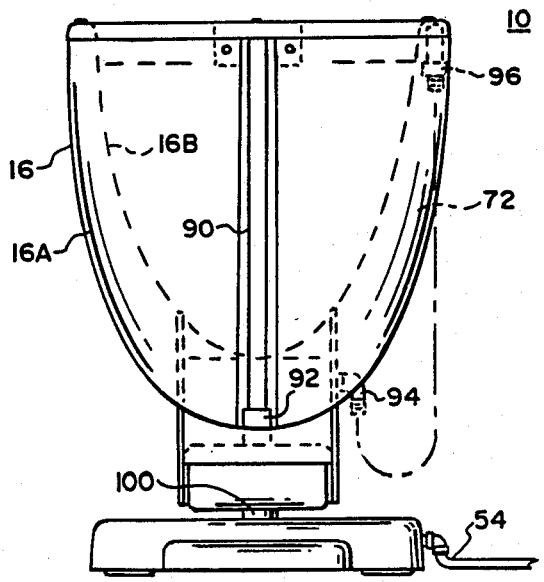
FIG. 5 is a side elevational view of the bathing system of FIG. 1 in the bathing position.

In FIG. 5, there is shown a side elevational view of the bathing system 10 having a portion of the transmission system visible, which portion includes a flexible curved rack 90 and pinion 92 capable of moving the curved rack 90 in a rotary direction to move the tub wall 16 to an open position. As shown in FIG. 5, the tub is rotated so that the curved rack 90 moves into the paper on which FIG. 5 is drawn, and thus moves to the position shown in FIG. 2 where the seat is visible with the patient facing out of the paper when the tub has been fully moved to the entering-and-exiting position. This is accomplished by the pinion 92 engaging the teeth of the curved rack 90 and driving the rack until the tub has been rotated to its selected position.

To permit sparging with air or supplying warming air to the patient, the blower outlet 94 is connected by a hose, shown broken away in this view, to a blower inlet 96 to form a flexible connection to the space between the double tub walls 16A and 16B of the tub, thus providing a path through tubing 64 for the warm air to proceed downwardly to the sparger outlets 80 (FIG. 4).

Because the drive motor is mounted on a rotatable shaft 100, the entire mechanism can be turned by means of lever 43 up to 90 degrees in a horizontal plane about the shaft. This feature of the bathing system 10 is thus intended to facilitate tub cleaning in confined spaces and to permit a wheelchair patient to enter the tub from a passage way adjacent to the confined space.

Figure 6:
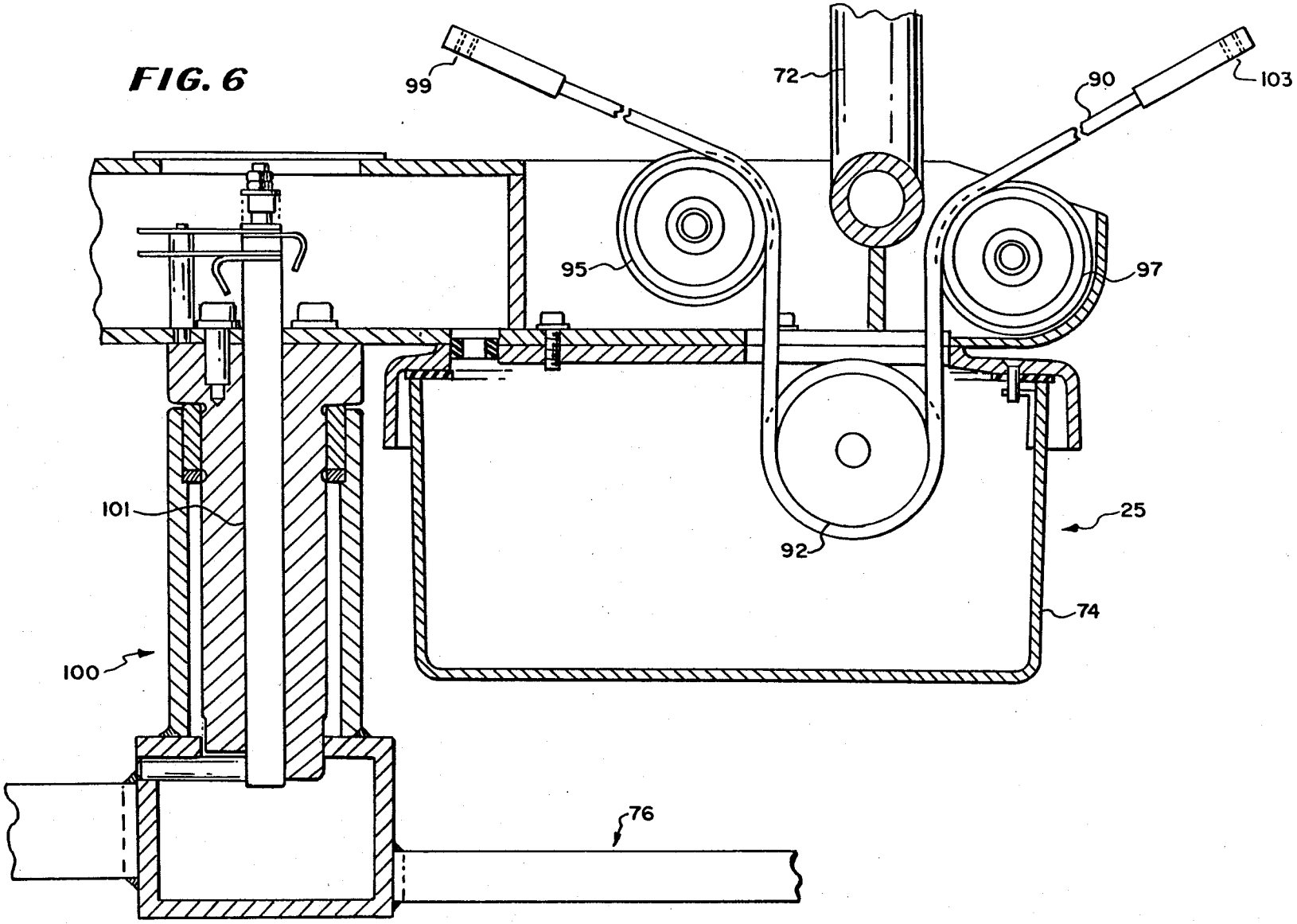
FIG. 6 is an enlarged sectional fragmentary view of a positioning system for the bathing system of FIG. 1.

In FIG. 6, there is shown a fragmentary, sectional enlarged view of a portion of the positioning mechanism 25 having the drive housing 74, the shaft 100 and the toothed belt 90. As shown in this view, the pinion 92 within the housing 74 engages the teeth and drives the belt 90 which in turn rotates the tub wall 16 (FIG. 5) by applying tension on its anchor points and engaging the wall services as it moves under the driven power of the pinion. The shaft 100 includes an electrical service tube 101 to permit electrical connection to the blower (not shown in FIG. 6) and is generally mounted to permit rotation to provide 90 degree movement of the tub wall 16 in a horizontal plane to change its orientation with respect to an alcove as will be described more fully hereinafter.

To drive the flexible neoprene toothed belt or rack 90, the pinion 92 rotates within the housing to pull the toothed belt by engaging teeth in one direction or another over idler rolls 95 and 97 with the belt 90 being fastened by bolts through bolt holes 99 and 103 at different ends of the toothed belt 90, shown broken away and unattached for illustrative purposes in FIG. 6. With this arrangement, the elevator motor pivots the tub 16 about a horizontal pivot axis between the entering-and-exiting position and the bathing position as illustrated by FIGS. 1–5 above.

Figure 7:
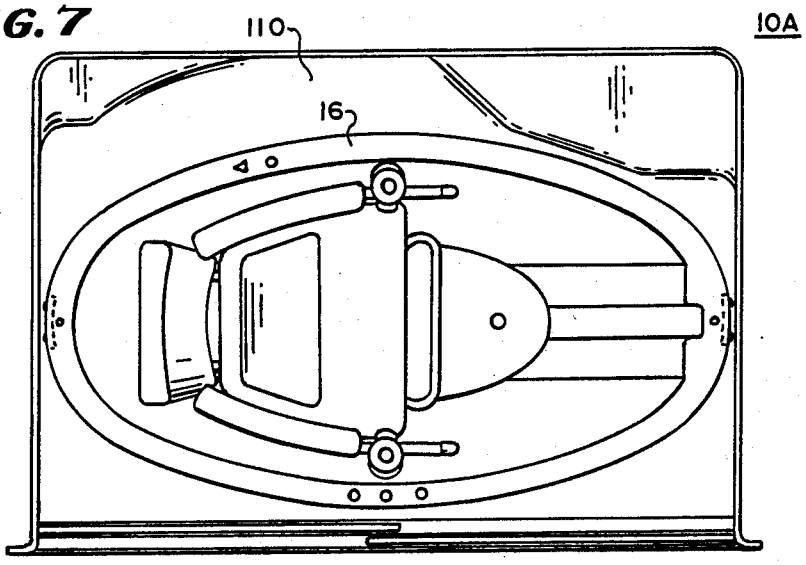
FIG. 7 is a top view of another embodiment of a bathing system.

In FIG. 7, there is shown a top view of a bathing system 10A substantially similar to the bathing system 10 in which identical parts are indentified by identical reference numerals. However, the bathing system 10A is designed to fit within an alcove 110. In this embodiment, the tub, when it is in the bathing position shown in FIG. 6, fits within the confined space of a standard alcove. To fit in a standard alcove, the ends of the tub wall 16 at the extremes of the longitudinal axis have a width small enough to fit within a space of approximately 60 inches and the center portion of the wall along the minor axis fits within an enlarged space of approximately 40 inches so that its widest portion of the tub extends into an alcove space where the faucets are located and the mixing valve fits.

Figure 8:
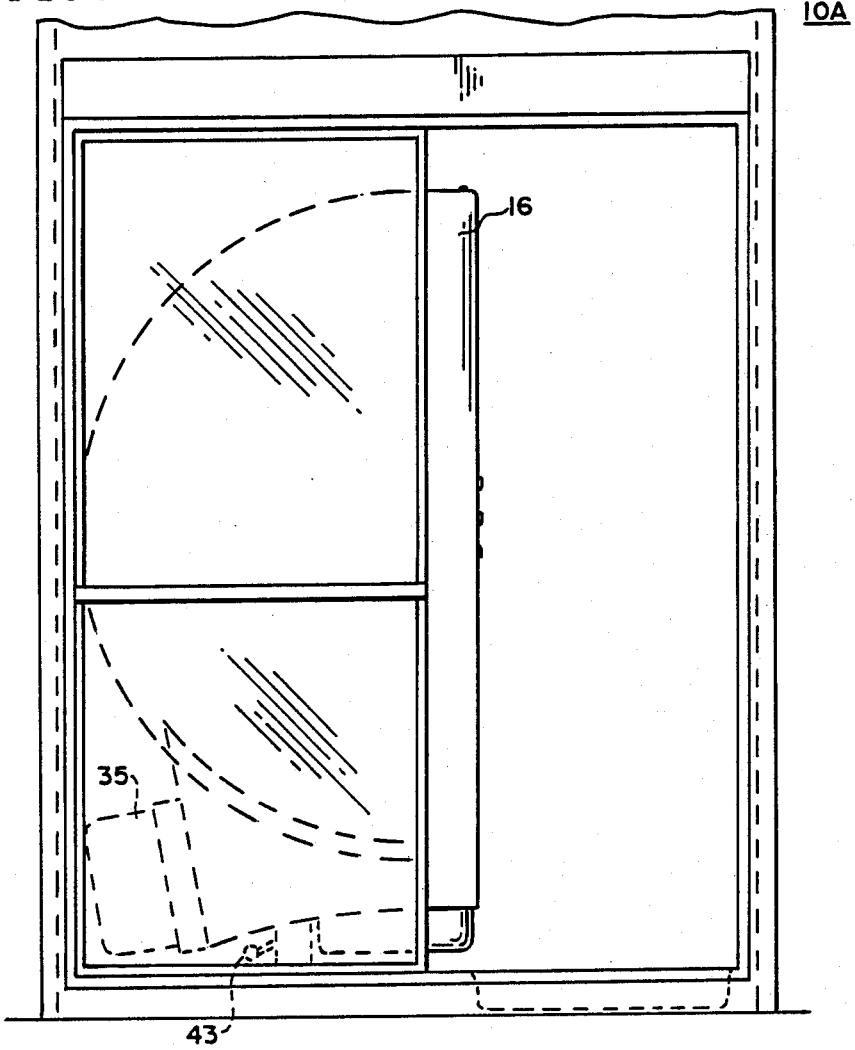
FIG. 8 is a side elevational view of the bathing system of FIG. 6.

In FIG. 8, there is shown an alcove 110 with the tub wall 16 of the bathing system 10A positioned in its entering-and-exiting position, which also serves as its storage position. The wall cutout forming the alcove may be a nominal 60 inches which represents a 2 inch clearance between the tub when the tub is in its bathing position as shown in FIG. 7. In FIG. 7, the tub may be pivoted horizontally on its shaft 100 up to 90 degrees to facilitate patient entry and then rotated back 90 degrees with the patient in it and pivoted to the bathing position using the control section 40 or manually. For that purpose, the curved flexible rack and pinion arrangement mounted on the cantilever support serves to permit the tub to be fully in its bathing position in the minimum space and yet be moved into the alcove position above the supporting arm by the cantilever mounted blower and drive mechanisms.

Figure 9:
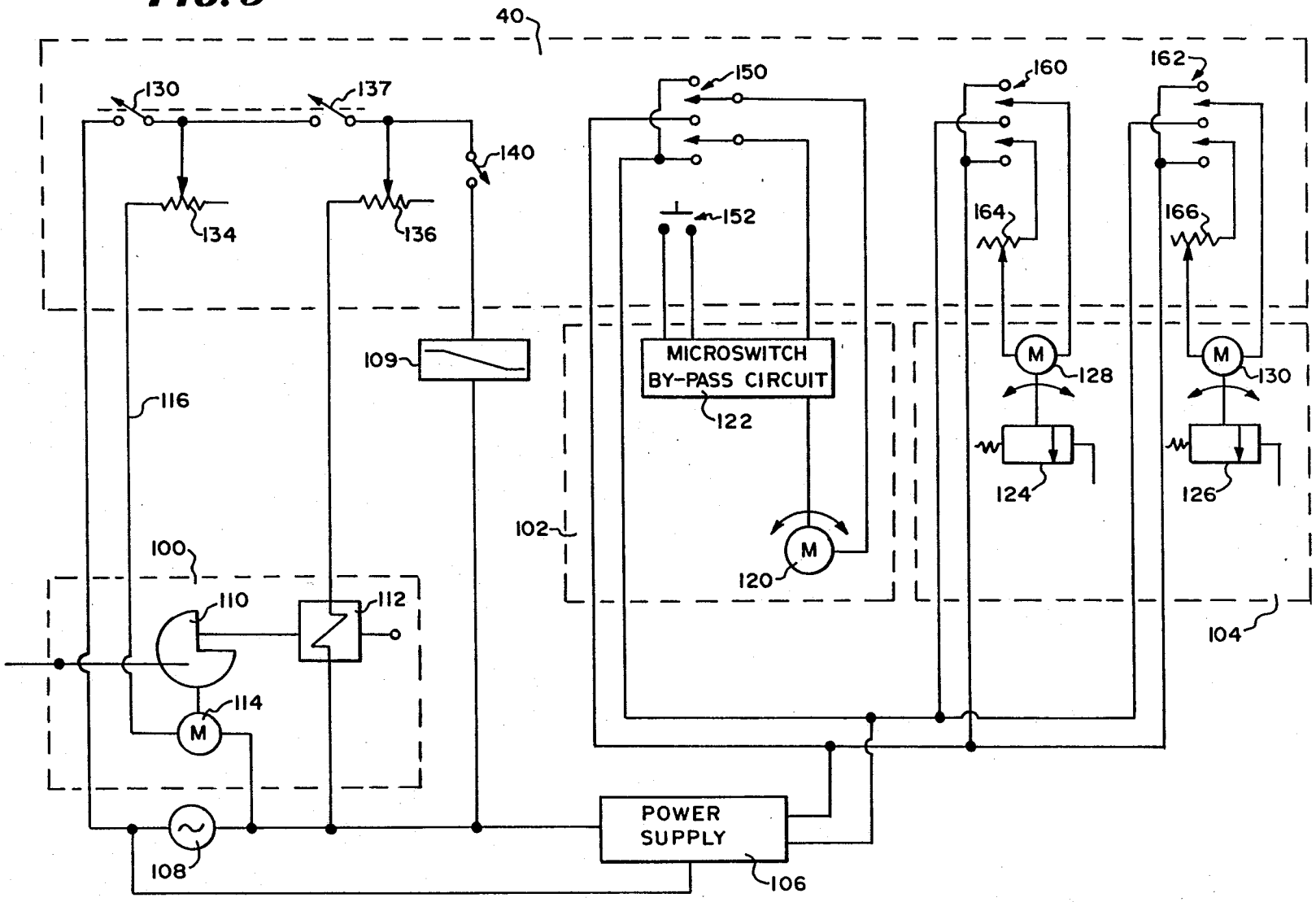
FIG. 9 is a schematic circuit diagram of the control unit of the bathing system in accordance with the invention.

In FIG. 9, there is shown a simplified schematic circuit diagram of one possible control system for the bathing systems 10 and 10A having control sections 40 and 42, a warm air circuit 100, a tub motion circuit 102, a water control circuit 104 and a power supply 106. The circuit itself is not part of the invention except insofar as it cooperates with the structural elements described above to implement the advantages of the bathing systems 10 and 10A. Moreover, in the preferred embodiment, the movement of the tub between the bathing and the entering-and-exiting position is accomplished by an elevator drive unit. A microswitch breaks the power line at the end of motion to each position and the circuit must be manually started.

To supply warm air to the tub, the warm air circuit 100 includes a blower 110 and a heater 112. The blower 110 is driven by a blower motor 114 electrically connected through a conductor 116 and a potentiometer across a source of AC power 108 from the heater 112. The heater 112 is also electrically connected to the source of power 108 through a potentiometer in the control panel 40 and electrically connected through a conduit to permit air to flow through the heater 112 and the blower 110 under the pulling power of the blower 110. The blower 110 communicates with the sparging hose in a manner described above in connection with FIGS. 1–6 so that the patient may energize the blower 110 and heater 112 and control the amount of air and the temperature of the air from the control panel 40 to provide warming action when the tub is in the entering-and-exiting position and a sparging action when in the bathing position.

To move the tub wall 16 (FIGS. 1–7) between the bathing position and the entering-and-exiting position, the tub motion circuit 102 includes a two-way motor 120 and a microswitch by-pass circuit 122. The direction of motion of the motor is controlled by a switch within the control panel 40 to be described hereinafter so the patient may energize the tub to move it in one direction or the other directly from the control panel 40. When the tub is positioned against the detent in the bathing position or at the end of its travel through 90 degrees in the entering-and-exiting position, a microswitch is contacted in the microswitch by-pass circuit 122 in a conventional manner to open the circuit applying power to the two-way motor 120. Power to the two-way motor 120 is supplied by a power supply 106 with the polarity determined from the switch in the control panel 40, with the power supply 106 being energized from the source of power 108.

To control the temperature of the water filling the tub in the preferred embodiment, manually controlled valves apply water to a conventional mixing valve and from there to the faucet. However, in the embodiment of FIG. 9, the water control circuit 104 includes first and second infinitely variable valves 124 and 126 each controlled by a different DC motor 128 and 130 for this purpose. The motors are each controlled in direction by switches in the control panel 40 and in speed by potentiometers so that they may be individually adjusted. A temperature measuring bulb supplies an indication of the temperature to a display panel so that the operator may know the temperature of the water as he adjusts the first and second infinitely variable valves 124 and 126, one of which controls the flow of warm water and the other of which controls the flow of cold water through the faucets into the tub wall 16 (FIGS. 1–7).

To permit water to be drained or prevent water from being drained in the preferred embodiment, an ordinary plug on a string is used. However, in the arrangement of FIG. 9, an AC solenoid 109 is controlled by a switch from the control panel 40 to mechanically close or open the drain.

To control the temperature and flow of air into the tub wall 16 (FIGS. 1–7) in the preferred embodiment, a self-heating blower supplies warm air through a manually controlled valve. In the embodiment of FIG. 9, the control sections 40 and 42 include first and second gang switches 130 and 137 each connecting a respective one of the two potentiometers 134 and 136 into circuit with the source of power 108 and a respective one of the blower 110 and heater 112. With this arrangement, the potentiometers 134 and 136 may be individually adjusted to adjust the speed of the blower and the heat provided by the heater 112 when air is to be blown and may terminate and start the flow of air through the gang switches 130 and 137 from the control sections 40 and 42.

To control the AC solenoid 109, the control section 40 includes a switch 140, which when closed connects the source of power 108 across the AC solenoid 109 to open the normally closed drain and permit water to drain from the tub. With this arrangement, water may be easily drained by the patient.

To move the tub from one position to the other, the control section 40 includes a double-throw double-pole switch 150 which, in one position connects the power supply in a first polarity across the motor 120 to move the tub in one direction and when thrown against the opposite pole, reverses the direction of the motor 120 and drives it in the opposite direction to move the tub to the other position. In circuit with the motor 120 is the microswitch by-pass circuit 122 which may be closed to initiate motion by depressing the switch 152 temporarily to move the tub away from the microswitch which has opened the circuit.

To control the first and second infinitely variable valves 124 and 126 for supplying hot and cold water to the tub from control section 40, there is connected to each of the first and second infinitely variable valves 124 and 126 a different one of the two double-pole double-throw switches 160 and 162 which in one position cause the valve to be opened to a greater extent and in the other position cause the valve to be closed. The rate of opening and closing is adjustable by respective ones of the potentiometers 164 and 166 in circuit with the first and second infinitely variable valves 124 and 126.

The above circuit is illustrative only and many different circuits may be used to accomplish the same purposes. The purpose of the circuit and panel is to permit the patient to control the bathing operation while remaining seated within the tub for maximum convenience. This eliminates the need for assistance so that an ambulatory patient may bathe without another person with a minimum of effort and discomfort.

In the use of the bathing systems 10 and 10A, the tub wall 16 is normally in its entering and exiting position. While in that position, the patient, being at least partly ambulatory, may sit in the seat means 24 (FIGS. 2 and 3) facing forward in a position in which his hands may reach the control section 40 (FIGS. 1–4 and 7).

While in the seating position, the patient may actuate the control section 40 to pivot the tub wall 16. The control section 40 actuates an electric motor with a worm drive reducer that drives a pinion. The pinion grasps the tooth-belt extending along the outer wall of the tub wall 16 and drives it so the tub rotates through 90 degrees while the chair pivots about the pivot axis on the pivot sections 20A (FIGS. 2–4) and 20B (FIGS. 1, 2 and 4) to remain erect. Because the pivot axis is located at the center of a circular outer outline in the plane of the major axis with the seat being located to position the patient, the tub wall 16 moves to a position where the patient's head is above the edge of the tub but the tub nonetheless surrounds the chair.

When the bathing system is in the entering and exiting position, the patient may actuate the controls to cause a whirlpool blower to blow warm air through a hose to a location near the edge of the tub wall 16 where it is blown through the double tub walls 16A and 16B to a sparging opening behind the patient. Because the edge of the walls extend outwardly so that the seat is recessed in the concave chamber of the tub with the edge of the tub being in a plane forward of the patient, the warm air is circulated within that chamber to keep the patient warm.

When the tub is in its bathing position in the preferred embodiment, valves are manually operated to apply water. In the system of FIG. 9, the patient may utilize the control sections 40 and 41 (FIGS. 1–4 and 7) to open a valve permitting water to enter the tub and fill it for bathing purposes. The patient may again cause the whirlpool blower to blow warm water into the tub through the sparging outlet, which now is located beneath the chair to agitate the water.

When bathing is completed, the patient may pull the plug or in the embodiment of FIG. 9, the patient may again actuate the controls in the control section to drain liquid from the tub through the bottom. When it is empty, the controls may be used to return the tub wall 16 to the entering-and-exiting position. The patient may energize or deenergize the blower at any time during this operation so that warm air is blown across him within the chamber thus keeping him warm during the exiting phase of bathing or it may be kept on continuously. This warm air can also dry the patient.

It can be understood from the above description that the bathing systems 10 and 10A have several advantages such as: (1) they can be easily entered by an ambulatory patient and operated by the patient without the aid of another person; (2) the patient can control the tub to move it from a bathing position to an entering position himself without the aid of an operator; (3) in the entering and exiting positions, the patient can cause warm air to be blown about the patient to prevent chilling and provide drying; (4) in some embodiments, the tub may fit within a confined space of a 60-inch alcove to be conveniently stored and used; and (5) the tub may be moved between the entering and existing position and the bathing position by a simple mechanism which drives along a curved center line, preferably hemispherical, without the need for corner post supports that occupy excessive space to permit the tub to be compact and economical and yet enclose the patient both in the bathing, entering-and-exiting positions.

Although a preferred embodiment of the invention has been described with some particularity, many modifications and variations of the invention are possible within the light of the above teachings. Therefore, it is to be understood that, within the scope of the appended claims, the invention may be practiced other than as specifically described.

What is claimed is:

1. A bathing system comprising:

a tub means adapted to hold water;

a seat mounted in a position suitable for a bather to sit in it;

means for moving said tub means between a bathing position in which it holds water and an entering and exiting position in which it is upright without substantially changing said position of said seat, whereby the bather may remain seated while said tub means moves between an entering and exiting position and a bathing position;

said tub means having a depth, a height and a width with said depth extending from an edge forming an opening downwardly to a closed bottom whereby when said tub means is in bathing position, said depth extends downwardly into said water and when said tub means is in an entering position, said depth is horizontal;

a sparging system means for blowing warm air into said tub means; said tub means having a concave tub chamber; said seat being located when said tub means is in said entering and exiting position such that the edge of said tub means extends beyond said seat, whereby warm air blows within the concave tub chamber around said patient while said patient is recessed in said chamber.

2. A bathing system according to claim 1 in which:

said tub means has a longitudinal axis, a semimean axis and a minor axis, said longitudinal, semimean, and minor axes being orthogonal;

said tub means has a length in the direction of said longitudinal axis of less than 60 inches;

said tub means has a depth in the direction of said semimean axis in the range of 25 inches and 40 inches;

said tub means has a width along the minor axis in a range of 20 inches and 35 inches;

said tub means has a height above said seat to a wall of said tub means of at least 32 inches when said tub means is in said entering and exiting position; and a depth beneath said seat of at least 20 inches when said tub means is in said entering and exiting position.

3. A bathing system in accordance with claim 2 further including:

faucet means for permitting water to enter said tub means;

said faucet means clearing the edge of said tub means and said seat means whereby the operator may enter said tub means without coming into contact with said faucet means and said faucet means is positioned above said tub means when said tub means is in the bathing position.

4. A bathing system in accordance with claim 2 in which said tub means has a height above said seat along said major axis of at least 32 inches when said tub means is in said entering and exiting position, whereby said tub means may be mounted in a standard alcove.

5. A bathing system according to claim 4 in which said means for moving includes:

stationary base means for supporting said tub means;

first and second motion transmission means;

said first and second motion transmission means being engageable, whereby said first transmission means can drive said second transmission means;

motor means for driving said first transmission means;

one of said first and second transmission means being connected to said stationary means and the other to said tub means, whereby said tub means may be moved from said entering position to said bathing position.

6. A bathing system according to claim 5 in which said first transmission means and motor means are connected to said base means and said second transmission means is a curved rack along a center line of said tub means.

7. A bathing system according to claim 6 in which said tub means has a semicircular cross section and said curved rack extends along at least 90 degrees of said semicircular cross section.

8. A bathing system according to claim 7 in which said curved rack is a flexible belt having teeth therein.

9. A bathing system comprising:

a tub means adapted to hold water;

a seat mounted in a position suitable for a bather to sit in it;

means for moving said tub means from a bathing position in which it holds water to an entering and exiting position in which it is upright without substantially changing said position of said seat from said bathing position, whereby the bather may remain seated while said tub means moves from an entering and exiting position to the bathing position;

said tub means having a depth, a height and a width with said depth extending from an edge forming an opening downwardly to a closed bottom whereby when said tub means is in bathing position, said depth extends downwardly into said water and when said tub means is in an entering position, said depth is horizontal;

said means for moving including stationary base means for supporting said tub means; first and second transmission means; and motor means for driving said first transmission means;

said first and second transmission means being engable, whereby said first transmission means can drive said second transmission means;

one of said first and second transmission means being connected to said stationary base means and the other to said tub means, whereby said tub means may be moved from said entering position to said bathing position;

said means for moving comprising means for moving the tub about a horizontal axis that remains during the movement at an elevation from a floor within the range of 15 inches to 40 inches, whereby the tub may be used in a confined space.

10. A bathing system in accordance with claim 9 in which said tub means includes drain means and means for opening and closing the drain means under the control of said operator.

11. A bathing system in accordance with claim 10 further including:

faucet means for permitting water to enter said tub means;

said faucet means clearing the edge of said tub means and said seat means whereby the operator may enter said tub means without coming into contact with said faucet means and said faucet means is positioned above said tub means when said tub means is in the bathing position.

12. A bathing system comprising:

a tub adapted to hold water;

a seat mounted in a position suitable for a bather to sit in it;

means for moving said tub from a bathing position in which it holds water to an entering and exiting position in which it is upright without substantially changing said position of said seat from said bathing position, whereby the bather may remain seated while said tub moves from an entering and exiting position to the bathing position;

said tub having a depth, a height and a width, with said depth extending from an edge forming an opening downwardly to a closed bottom whereby when said tub is in bathing position, said depth extends downwardly into said water and when said tub is in an entering position, said depth is horizontal;

said tub having a longitudinal axis, a semimean axis and a minor axis;

said tub having a length in the direction of said longitudinal axis of less than 60 inches;

said tub having a depth in the direction of said semimean axis in the range of 25 inches and 40 inches;

said tub having a width along the minor axis in a range of 20 inches and 35 inches;

said tub having a height above said seat to a wall of said tub of at least 36 inches when said tub is in said entering and exiting position; and a depth beneath said seat of at least 20 inches when said tub is in said entering and exiting position; and means for pivoting said tub, said seat and said means for moving about a vertical axis wherein said tub, said seat and said means for moving may be turned for easier storage while in the entering and exiting position and may be moved between the entering and exiting position within a confined space.

13. A bathing system according to claim 19 in which said first transmission means and motor means are connected to said base means and said second transmission means is a curved rack along a center line of said tub means.

14. A bathing system according to claim 13 in which said tub means has a semicircular cross section and said curved rack extends along at least 90 degrees of said semicircular cross section.

15. A bathing system according to claim 13 further including a sparging system means for blowing warm air into said tub means; said tub means having a concave tub chamber; said seat being located when said tub means is in said entering and exiting position such that said warm air blows into said chamber.

16. A method of using a bathing system having a tub means comprising the steps of:

sitting in a seat mounted in a chamber means facing outwardly whereby the tub means is in an entering position and has its longitudinal axis vertical;

moving said chamber means from a position in which its longitudinal axis is vertical while a bather is in the seat to a position in which it holds water;

applying water;

draining;

moving the chamber means to an exiting position in which it is upright without substantially changing said position of said seat, whereby the bather may remain seated while said tub means moves between an entering or exiting position to the bathing position;

applying warm air to said chamber means while its longitudinal axis is in a vertical position and while the seat is recessed in the chamber; and controlling the change of position from a control means mounted within three feet of said seat.

17. A method according to claim 16 in which the step of moving said chamber means includes the step of driving a curved rack positioned along a center line of said tub means with a pinion through at least 50 degrees of rotation of said tub means.

18. A method according to claim 17 further including the step of applying air to the bather through the water while the tub means is in its bathing position.

19. A method according to claim 16 in which the step of moving said chamber means includes the step of moving said chamber means about a horizontal axis that remains during the movement at an elevation from a floor within the range of 15 inches to 40 inches whereby the tub means may be used in a confined space.

20. A method according to claim 19:

in which the step of moving said chamber means includes the steps of moving a chamber means having a length in the direction of its longitudinal axis which is less than 60 inches; a depth in the direction of its semimean axis in a range of 20 inches and 35 inches; a width along its minor axis is in a range of 20 inches and 35 inches; and a height above the seat along said longitudinal axis of at least 32 inches when said chamber means is in said entering and exiting position, wherein said chamber means may be mounted in a standard alcove; and pivoting said chamber means about a longitudinal axis before moving it from the entering and exiting position to the bathing position.

* * * * *